US008270859B2

(12) United States Patent
Oh

(10) Patent No.: US 8,270,859 B2
(45) Date of Patent: Sep. 18, 2012

(54) IMAGE FORMING APPARATUS AND CONTROL METHOD THEREOF

(75) Inventor: Han-sang Oh, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 437 days.

(21) Appl. No.: 12/556,647

(22) Filed: Sep. 10, 2009

(65) Prior Publication Data

US 2010/0092194 A1 Apr. 15, 2010

(30) Foreign Application Priority Data

Sep. 12, 2008 (KR) ..... 10-2008-0090182

(51) Int. Cl.
*G03G 15/00* (2006.01)
*G03G 15/02* (2006.01)
*G03G 15/08* (2006.01)
*G03G 15/06* (2006.01)

(52) U.S. Cl. ..... 399/49; 399/50; 399/53; 399/55

(58) Field of Classification Search ..... 399/46, 399/48, 49, 50, 53, 55
See application file for complete search history.

(56) References Cited

U.S. PATENT DOCUMENTS

| | | | | |
|---|---|---|---|---|
| 4,724,461 | A * | 2/1988 | Rushing | 399/48 |
| 5,072,258 | A * | 12/1991 | Harada | 399/50 |
| 5,107,302 | A * | 4/1992 | Bisaiji | 399/49 |
| 5,659,841 | A * | 8/1997 | Umeda et al. | 399/55 |
| 6,744,995 | B2 * | 6/2004 | Fukuyama et al. | 399/50 |
| 2008/0170870 | A1 * | 7/2008 | Yamaguchi et al. | 399/49 |

FOREIGN PATENT DOCUMENTS

KR 1998-084092 12/1998

* cited by examiner

*Primary Examiner* — Sandra Brase
(74) *Attorney, Agent, or Firm* — Stanzione & Kim, LLP

(57) ABSTRACT

An image forming apparatus and a control method of the image forming apparatus. The image forming apparatus includes a photosensitive medium, a charger to charge the photosensitive medium, an exposing unit to expose light to the photosensitive medium to form a latent image on the photosensitive medium, a developing unit which is disposed opposite to the photosensitive medium to develop the latent image into a visible image, a density sensing unit to sense a density of an area of the photosensitive medium, and a controller to determine whether a preset developing condition corresponds to a background image generating condition based on the density sensed by the density sensing unit and to adjust the developing condition based on the determination.

16 Claims, 6 Drawing Sheets

IMAGE FORMING APPARATUS AND CONTROL METHOD THEREOF

CROSS-REFERENCE TO RELATED APPLICATIONS

This application claims the benefit of priority under 35 U.S.C. §119(a) from Korean Patent Application No. 10-2008-0090182, filed on Sep. 12, 2008 in the Korean Intellectual Property Office, the disclosure of which is incorporated herein by reference in its entirety.

BACKGROUND

1. Field of the Invention

Apparatuses and methods consistent with the present general inventive concept relate to an image forming apparatus and a control method thereof which can prevent generation of a background image.

2. Description of the Related Art

In general, an image forming apparatus of an electrophotographic type forms a visible image on a photosensitive medium based on a voltage difference between a surface voltage of a surface of the photosensitive medium and a developing bias voltage of a developing roller by means of a charger and an exposing unit; transfers the visible image on the photosensitive medium to a printing medium using a transfer unit; and fixes the transferred image on the printing medium using a fixing unit.

The surface voltage of the photosensitive medium may vary due to defects or deterioration of the charger, a control disorder of a charging voltage, etc. Further, the developing voltage may vary, for example, due to deterioration of a developer such as a toner. In such an abnormal condition, the amount of a developer attached to the photosensitive medium may increase, so that the developer may be attached to a non-image part on the photosensitive medium, thereby generating an abnormal background image.

In order to prevent the background image from being generated, an image forming apparatus is conventionally configured to predict changes in the life spans of components concerned, and to control printing based on the predicted changes. However, if predicted changes are incorrect due to changes in printing environments, the conventional image forming apparatus cannot prevent the background image from being generated.

SUMMARY

The present general inventive concept an image forming apparatus and a control method thereof which determines the possibility of generation of a background image based on the density of an image on a photosensitive medium and adjusts a developing condition to thereby prevent the generation of the background image.

Additional features and utilities of the present general inventive concept will be set forth in part in the description which follows and, in part, will be obvious from the description, or may be learned by practice of the present general inventive concept.

Embodiments of the present general inventive concept can be achieved by providing an image forming apparatus including a photosensitive medium, a charger to charge the photosensitive medium, an exposing unit to expose light to the photosensitive medium to form a latent image on the photosensitive medium, a developing unit which is disposed opposite to the photosensitive medium to develop the latent image into a visible image, a density sensing unit to sense a density of an area of the photosensitive medium, and a controller to determine whether a preset developing condition corresponds to a background image generating condition based on the density sensed by the density sensing unit and to adjust the developing condition based on the determination.

The controller may control the density sensing unit to sense a density of a non-image area on the photosensitive medium in a first test condition in which a background image is less likely to be generated compared with the preset developing condition and to sense a density of the non-image area on the photosensitive medium in a second test condition in which the background image is more likely to be generated compared with the preset developing condition.

The controller may control the photosensitive medium and the density sensing unit so that a portion of the photosensitive medium sensed in the first test condition is substantially the same as a portion of the photosensitive medium sensed in the second test condition.

The developing condition, the first test condition and the second test condition may be respectively set by varying at least one of a charging voltage applied to the photosensitive medium by the charger and a developing bias voltage applied to the developing unit.

The first test condition may be set such that a voltage difference between the charging voltage and the developing bias voltage is larger than that in the preset developing condition.

The second test condition may be set such that a voltage difference between the charging voltage and the developing bias voltage is smaller than that in the preset developing condition.

The density sensing unit may include a light emitting part which emits light to the photosensitive medium and a light receiving part which receives light reflected from the photosensitive medium to measure an amount of light reflected from the photosensitive medium.

The controller may adjust the developing condition at a predetermined cycle.

Embodiments of the present general inventive concept can also be achieved by providing a control method of an image forming apparatus including a photosensitive medium and a developing unit. The method includes charging the photosensitive medium at a predetermined voltage, applying a developing bias voltage to the developing unit, sensing a density of a non-image area of the photosensitive medium, determining whether a preset developing condition corresponds to a background image generating condition, and adjusting the developing condition based on the determination.

The sensing of a density may include sensing a density on the non-image area in a first test condition in which a background image is less likely to be generated compared with the preset developing condition; and sensing a density on the non-image area in a second test condition in which a background image is more likely to be generated compared with the preset developing condition.

The developing condition, the first test condition and the second test condition may be respectively set by varying at least one of a charging voltage applied to the photosensitive medium and a developing bias voltage applied to the developing unit.

The first test condition may be set such that a voltage difference between the charging voltage and the developing bias voltage is larger than that in the preset developing condition.

The second test condition may be set such that a voltage difference between the charging voltage and the developing bias voltage is smaller than that in the preset developing condition.

The adjusting of the developing condition may include determining whether a ratio between the sensed densities of the first and second test conditions is beyond a predetermined allowable correction range, and correcting the developing condition within the allowable correction range if the ratio is within the predetermined allowable correction.

The method may further include controlling the image forming apparatus such that a portion of the photosensitive medium sensed in the first test condition is substantially the same as a portion of the photosensitive medium sensed in the second test condition.

The adjusting of the developing condition may be performed at a predetermined cycle.

Embodiments of the present general inventive concept can also be achieved by providing an image forming apparatus including a photosensitive medium to form an image thereon, a density sensing unit to sense a density of an area of the photosensitive medium, and a controller to determine whether a preset developing condition corresponds to a background image generating condition based on the density sensed by the density sensing unit and to adjust the developing condition based on the determination.

Embodiments of the present general inventive concept can also be achieved by providing a method of controlling an image forming apparatus including a photosensitive medium and a developing unit, the method including applying a preset developing condition including a charging voltage to be applied to the photosensitive medium and a developing bias voltage to develop an image on the photosensitive medium, determining whether the preset developing condition corresponds to a background image generating condition, and adjusting the developing condition based on the determination.

Embodiments of the present general inventive concept can also be achieved by providing an image forming apparatus including a photosensitive medium to form an image thereon, a charging unit to charge the photosensitive medium with a charging voltage, and a controller to adjust the charging voltage of the charging unit according to a characteristic of an area of the photosensitive medium.

The characteristic of the area of the photosensitive medium may include a density of a background image of the image formed on the photosensitive medium.

BRIEF DESCRIPTION OF THE DRAWINGS

These and/or other features and utilities of the present general inventive concept will become apparent and more readily appreciated from the following description of the exemplary embodiments, taken in conjunction with the accompanying drawings, of which.

DETAILED DESCRIPTION OF THE EMBODIMENTS

Figure 1:
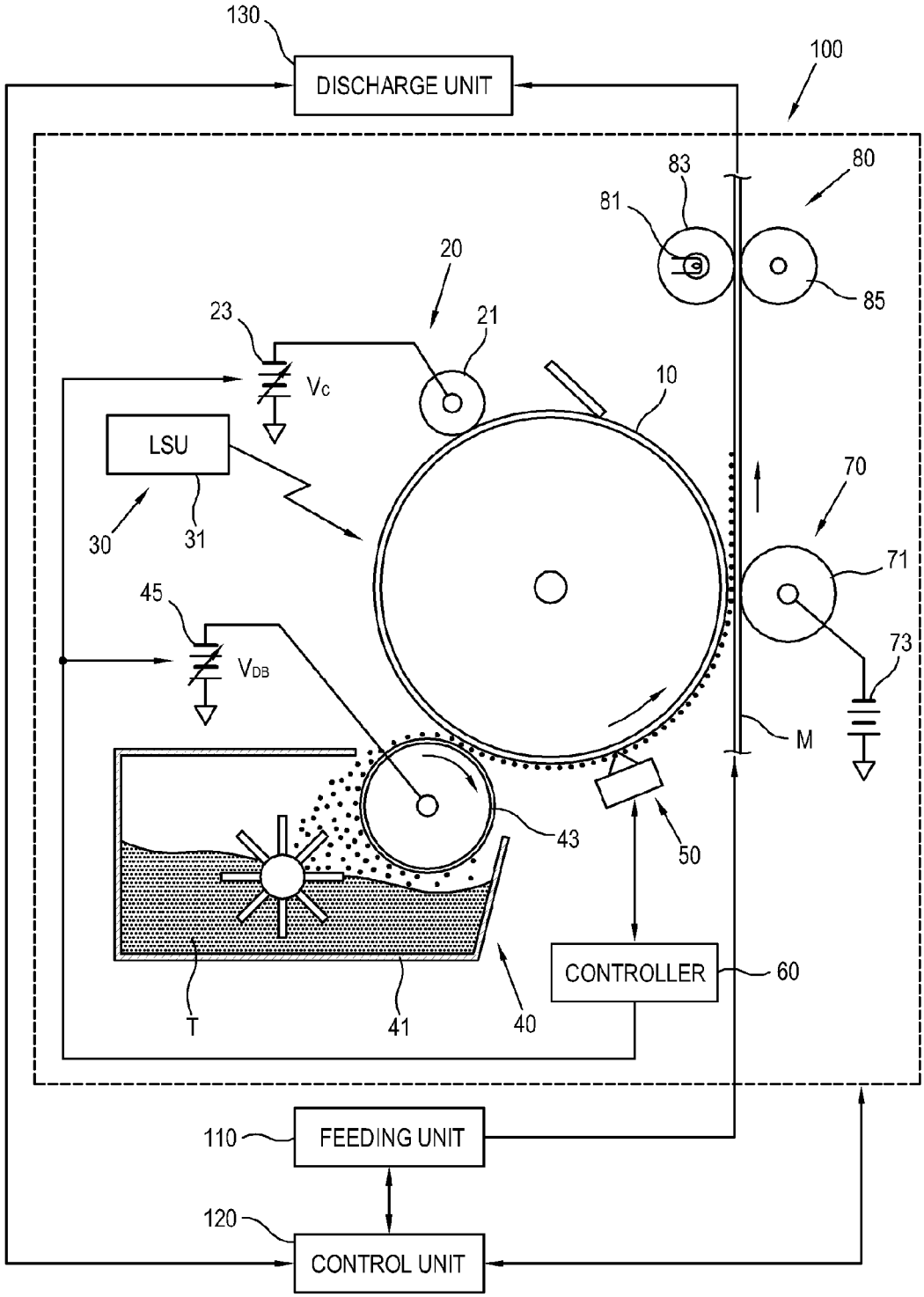
FIG. 1 is a schematic diagram illustrating an image forming apparatus according to an exemplary embodiment of the present general inventive concept.

Reference will now be made in detail to the exemplary embodiments of the present general inventive concept, examples of which are illustrated in the accompanying drawings, wherein like reference numerals refer to like elements throughout. The exemplary embodiments are described below so as to explain the present general inventive concept by referring to the figures.

FIG. 1 is a schematic diagram illustrating an image forming apparatus according to an exemplary embodiment of the present general inventive concept. Referring to FIG. 1, the image forming apparatus may include an image forming unit 100, a feeding unit 110, a control unit 120, and a discharge unit 130. The image forming unit 100 may include a photosensitive medium 10, a charger 20, an exposing unit 30, a developing unit 40, a density sensing unit 50 and a controller 60. The control unit 120 may include the controller 60.

The control unit 120 may control the feeding unit 110, the image forming unit 100, and the discharge unit 130 to perform an image forming operation. For example, the control unit 120 may control the feeding unit 110 to feed a printing medium M from the feeding unit 110 to the image forming unit 100. The control unit 120 may then control the image forming unit 100 to form an image on the printing medium M. The control unit 120 may then control the image forming unit 100 to feed the printing medium M to the discharge unit 130. The control unit 120 may then control the discharge unit 130 to discharge the printing medium M from the image forming apparatus 1.

Referring back to FIG. 1, the charger 20 charges the photosensitive medium 10 to provide a predetermined voltage to a surface of the photosensitive medium 10. The charger 20 may include a charging roller 21 to contact the photosensitive medium 10 and a charging power source 23 to apply a charging voltage $V_C$ to the charging roller 21. The charger 21 may be provided as a corona discharge type charger which may be disposed spaced apart from the photosensitive medium 10.

The exposing unit 30 scans a light beam on an image forming position of the photosensitive medium 10 to form a latent image. The exposing unit 30 may include a light scan unit (LSU) 31 and a linear exposing unit (not illustrated) arranged opposite to the photosensitive medium 10 in a main scanning direction of the printing medium M.

The developing unit 40 applies a toner T to the latent image on the photosensitive medium 10 to form a visible image on the photosensitive medium 10. The developing unit 40 may include a toner cartridge 41 in which a charged toner is contained, a developing roller 43 disposed opposite to the photosensitive medium 10, and a developing power source 45 to apply a developing voltage $V_{DB}$ to the developing roller 43.

The density sensing unit 50 senses the density of an image on the photosensitive medium 10. The controller 60 adjusts a developing condition based on the sensed image density, which will be further described later.

The image forming apparatus according to the present exemplary embodiment may further include a transfer unit 70 to transfer the visible image on the photosensitive medium 10 to a printing medium M, and a fixing unit 80 to fix the transferred image on the printing medium M.

The transfer unit 70 may include a transfer roller 71 disposed opposite to the photosensitive medium 10 with the printing medium M being interposed therebetween, and a transfer power source 73 to apply a transfer voltage to the transfer roller 71.

The fixing unit 80 may include a heat source 81, a thermal roller 83 heated by the heat source 81, and a pressing roller 85 disposed opposite to the thermal roller 83 to press the printing medium M. The printing medium M may be fed to the photosensitive medium 10 and the transfer roller 71 to transfer an image from the photosensitive medium 10 to the printing medium M, and then the printing medium M may be fed to be interposed between the thermal roller 83 and the pressing roller 85 to fix the image to the printing medium M.

Figure 2:
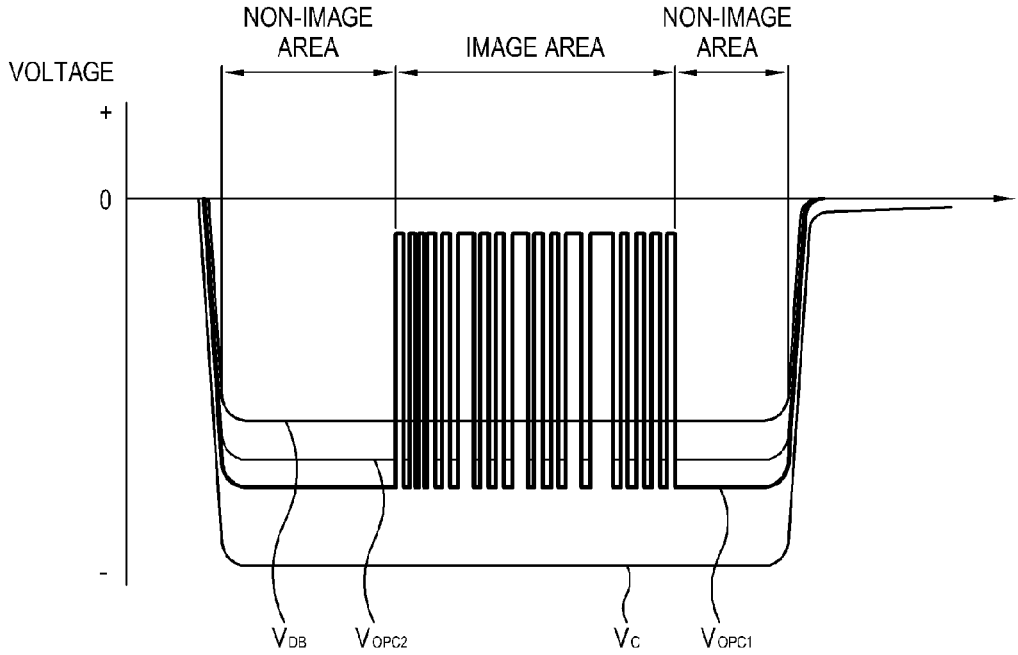
FIG. 2 is a schematic graph illustrating a charging voltage $V_C$, a developing bias voltage $V_{DB}$ and surface voltages $V_{OPC1}$ and $V_{OPC2}$ of a photosensitive medium of an image forming apparatus according to an exemplary embodiment of the present general inventive concept.

FIG. 2 is a schematic graph illustrating a charging voltage $V_C$, a developing bias voltage $V_{DB}$, and surface voltages $V_{OPC1}$ and $_{VOPC2}$ of the photosensitive medium 10 in the image forming apparatus according to an exemplary embodiment of the present general inventive concept. $V_{OPC1}$ represents a normal surface voltage of the photosensitive medium 10 in a normal developing condition and $V_{OPC2}$ represents a second test surface voltage of the photosensitive medium 10 in a second test condition in which a background image may be easily generated (to be described later). The surface voltages $V_{OPC1}$ and $V_{OPC2}$ vary depending on the magnitude of the charging voltage $V_C$, the kind and state of the photosensitive medium 10, etc. In a non-image area of the photosensitive medium 10, the magnitudes of the voltages $V_C$, $V_{DB}$, $V_{OPC1}$ and $V_{OPC2}$ have the following relationship, where $V_{DB}<V_{OPC2}<V_{OPC1}<Vc$. The normal surface voltage $V_{OPC1}$ has a greater magnitude than the second test surface voltage $V_{OPC1}$ in absolute value. That is, a difference between the surface voltage $V_{OPC2}$ of the photosensitive medium 10 and the developing voltage $V_{DB}$ is smaller than a difference between the surface voltage $V_{OPC1}$ of the photosensitive medium 10 and the developing voltage $V_{DB}$. Thus, a background image may be generated in the second test condition even when the background image is not generated in the normal developing condition. Accordingly, the normal developing condition may be adjusted based on the presence or absence of the background image in the second test condition, so as to prevent generation of the background image.

The density sensing unit 50 senses the density of an image formed on an image area of the photosensitive medium 10 and/or the density of a non-image area of the photosensitive medium 10. The density sensing unit 50 senses the density of a non-image area of the photosensitive medium 10 when a background image is generated and/or when a background image is not generated. For example, the density sensing unit 50 may sense a reflection rate of the non-image area of the photosensitive medium 10 to determine the density of the non-image area. The sensed density of the non-image area is used to adjust a developing condition, which will be described later.

Figure 3:
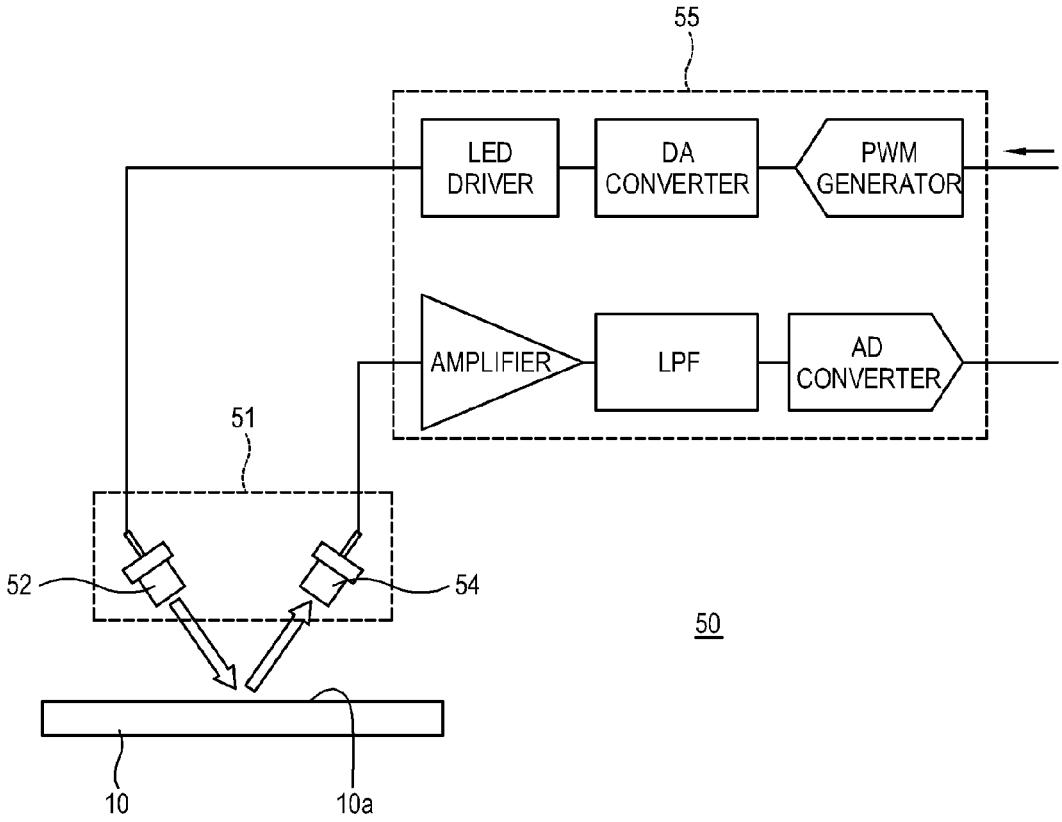
FIG. 3 is a schematic diagram illustrating a density sensing unit of an image forming apparatus according to an exemplary embodiment of the present general inventive concept.

FIG. 3 is a schematic diagram illustrating the density sensing unit 50 according to an exemplary embodiment of the present general inventive concept. As illustrated in FIG. 3, the density sensing unit 50 may include an optical sensor 51 and a circuit 55 to control the optical sensor 51. The optical sensor 51 may be a non-contact optical sensor.

The optical sensor 51 includes a light emitting part 52 to emit light to the photosensitive medium 10, and a light receiving part 54 to receive the light emitted from the light emitting part 52 and reflected from the photosensitive medium 10. In other words, the light emitted from the light emitting part 52 reflects off of the photosensitive medium 10 and is received by the light receiving part 54.

The sensing of the density of an area of the photosensitive medium 10 may be performed at various intervals of an image forming operation. For example, the density of an area of the photosensitive medium 10 may be sensed after forming the developed image, after transferring the developed image to the printing medium M, before forming the developed image, during formation of the developed image, etc.

The circuit 55 includes devices to drive the light emitting part 52 which may include a PWM (Pulse Width Modulation) signal generator to generate a PWM signal according to an input signal from the controller 60, a DA converter to convert the digital PWM signal into an analog signal, and a light emitting part driver (for example, LED driver) to drive the light emitting part 52 (for example, LED). The circuit 55 may also include devices to process a signal detected by the light receiving part 54 which may include an amplifier to amplify an electrical signal photo-electrically converted from the signal received from the light receiving part 54, an LPF (Low Pass Filter) to remove noise included in the amplified signal, and an AD converter to convert the noise-removed signal into a digital signal.

With this configuration, the density sensing unit 50 may sense light reflected from a surface 10*a* of the photosensitive medium 10 through the light receiving part 54 and provide a corresponding signal to the controller 60. The controller 60 thereby detects a change in a reflection rate on a specific area of the photosensitive medium 10. Thus, the density sensing unit 50 can determine whether a normal visible image or an abnormal background image is formed on the photosensitive medium 10. For example, the controller 60 may detect a change in the reflection rate on the image area or the non-image area of the photosensitive medium 10. Additionally, the reflection rate on an area of the photosensitive medium 10 may change according to developer remaining on the photosensitive medium 10. For example, the more developer remaining on the photosensitive medium 10, the lower the reflection rate on the area of the photosensitive medium 10, and the less developer remaining on the photosensitive medium 10, the higher the reflection rate on the area of the photosensitive medium.

The controller 60 determines whether a preset developing condition corresponds to a background image generating condition through a signal from the density sensing unit 50, and adjusts the developing condition based on the determination. To this end, the controller 60 controls the density sensing unit 50 to sense the density on the non-image area of the photosensitive medium 10 in a first test condition and the second test condition, respectively.

The first test condition refers to a condition under which a background image is relatively difficult to generate compared with the preset developing condition. Thus, a signal sensed in the first test condition may be used as a reference signal for determining the presence or absence of a background image. The second test condition refers to a condition under which a background image can be easily generated compared with the preset developing condition.

The developing condition, the first test condition and the second test condition may be set by varying at least one of the charging voltage $V_C$ and the developing bias voltage $V_{DB}$.

Figure 4:
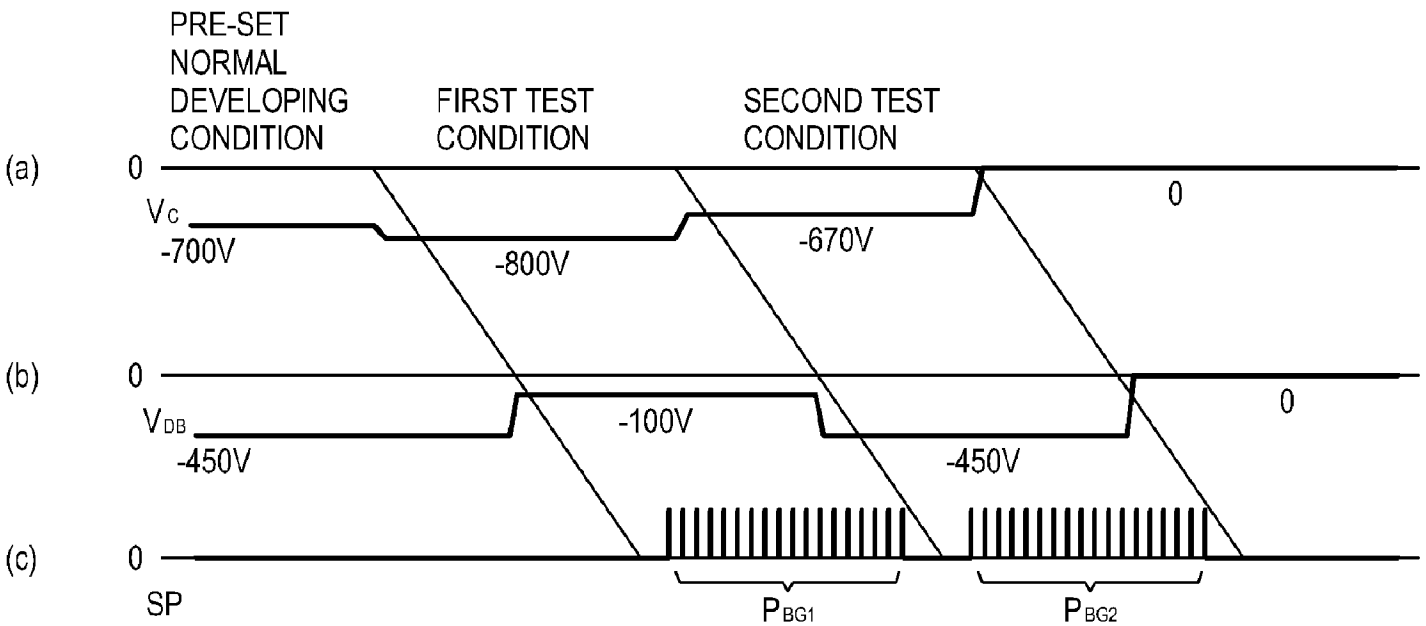
FIGS. 4(*a*)-(*c*) are graphs illustrating charging voltages $V_C$, developing bias voltages $V_{DB}$ and background image signal patterns, in a normal developing condition, a first test condition and a second test condition, respectively.

FIGS. 4(*a*)-4(*c*) illustrate a charging voltage $V_C$, a developing bias voltage $V_{DB}$ and a background image signal pattern SP in a preset normal developing condition, a first test condition and a second test condition, respectively.

As illustrated in FIG. 4, in the preset normal developing condition, the charging voltage $V_C$ and the developing bias voltage $V_{DB}$ may be set at −700V and −450V, respectively, to maintain a voltage difference of 250V. In this case, the surface voltage on the non-image area of the photosensitive medium 10 is $V_{OPC1}$, as described with reference to FIG. 2.

In the first test condition, the charging voltage $V_C$ and the developing bias voltage $V_{DB}$ are set such that a voltage difference therebetween is larger than that in the normal developing condition. For example, the charging voltage $V_C$ and the developing bias voltage $V_{DB}$ may be set at −800V and −100V, respectively, to maintain a voltage difference of 700V. In this case, a background image signal has a pattern $P_{BG1}$ in which a background image has not been generated, as illustrated in FIG. 4(*c*).

In the second test condition, the charging voltage $V_C$ and the developing bias voltage $V_{DB}$ are set such that a voltage difference therebetween is smaller than that of the normal developing condition. For example, the charging voltage $V_C$ and the developing bias voltage $V_{DB}$ may be set at −670V and −450V, respectively, to maintain a voltage difference of 220V. In this case, a background image signal may have a pattern $P_{BG2}$ in which a background image has been generated, as illustrated in FIG. 4(*c*).

To more accurately determine whether the background image in the second test condition has been generated, the controller 60 controls the density sensing unit 50 so that a portion of the photosensitive medium 10 sensed in the first test condition is substantially the same as a portion of the photosensitive medium 10 sensed in the second test condition. For example, the density sensing unit 50 may sense the density of a portion of the non-image area of the photosensitive medium 10 that corresponds to both the pattern $P_{BG1}$ and the pattern $P_{BG2}$.

Then, the controller 60 determines whether a background image has been generated based on the sensed results in the first and second test conditions. If the controller 60 determines that a background image has been generated, the controller 60 varies the charging voltage $V_C$ to adjust the developing condition from the normal developing condition to an adjusted developing condition, thereby preventing background image generation and developing image deterioration. For example, the charging voltage $V_C$ may be increased if the controller 60 determines that a background image has been generated. Additionally, the charging voltage $V_C$ may be decreased if the controller 60 determines that a background image has not been generated.

Further, the controller 60 may control the density sensing unit 50 and the charging and developing bias voltages $V_C$ and $V_{DB}$ so as to adjust the developing condition at a predetermined cycle. The controller 60 may adjust the developing condition based on a number of printing media printed. For example, controller 60 may adjust the developing condition for every 1,000 printing media having been printed. For example, the controller 60 may increase the charging voltage $V_C$ by a predetermined amount for every 1,000 printing media having been printed.

Hereinafter, a control method of an image forming apparatus according to an exemplary embodiment of the present general inventive concept will be described.

The control method according to an exemplary embodiment of the present general inventive concept includes charging the photosensitive medium 10 to provide a predetermined voltage to a surface of the photosensitive medium, applying a developing bias voltage to a developing unit, sensing the density of on a non-image area of the photosensitive medium 10, determining whether a preset developing condition corresponds to a background image generating condition, and adjusting the developing condition based on the determination.

The photosensitive medium 10 is charged to the predetermined surface voltage by a charging voltage $V_C$ applied from the charger 20. The charging voltage $V_C$ varies depending on a developing condition. In other words, the charging voltage $V_C$ of the normal developing condition, the first test condition, and the second test condition are different, as illustrated in FIGS. 4(*a*)-4(*c*).

The density sensing unit 50 senses the density of the non-image area of the photosensitive medium 10 using the background image signal pattern (SP) of the first and second test conditions.

In the present exemplary embodiment, the normal developing condition, the first test condition and the second test condition may be set by varying at least one of the charging voltage $V_C$ and the developing bias voltage $V_{DB}$.

The adjustment of the developing condition may include determining whether a ratio between the sensed densities of the non-image area of the photosensitive medium 10 with regard to the first and second test conditions is beyond an allowable correction range, and correcting the developing condition so that the adjusted developing condition is within the allowable correction range. The allowable correction range refers to a range of sensed densities where each sensed density within the range does not correspond to the generation of a background image, and each sensed density that exceeds the range does correspond to the generation of a background image.

Figure 5A:
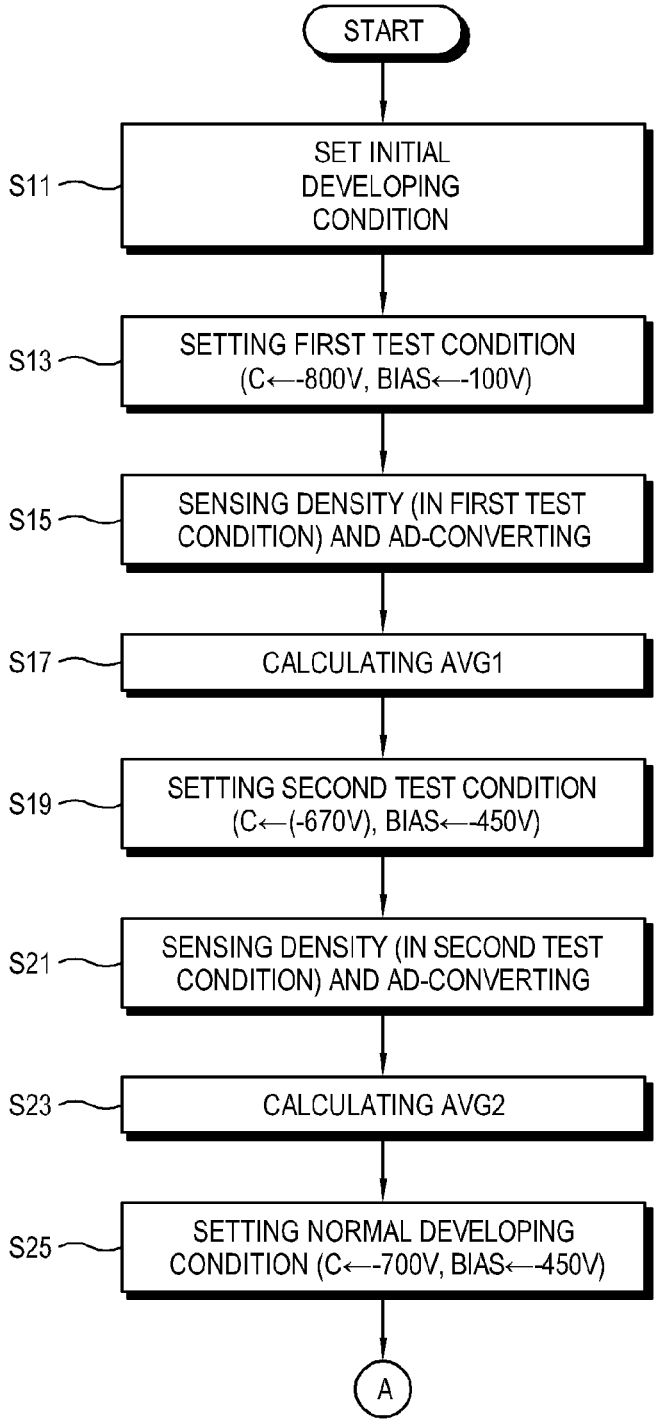
FIGS. 5A and 5B are flowcharts illustrating a control method in an image forming apparatus according to an exemplary embodiment of the present general inventive concept.
Figure 5B:
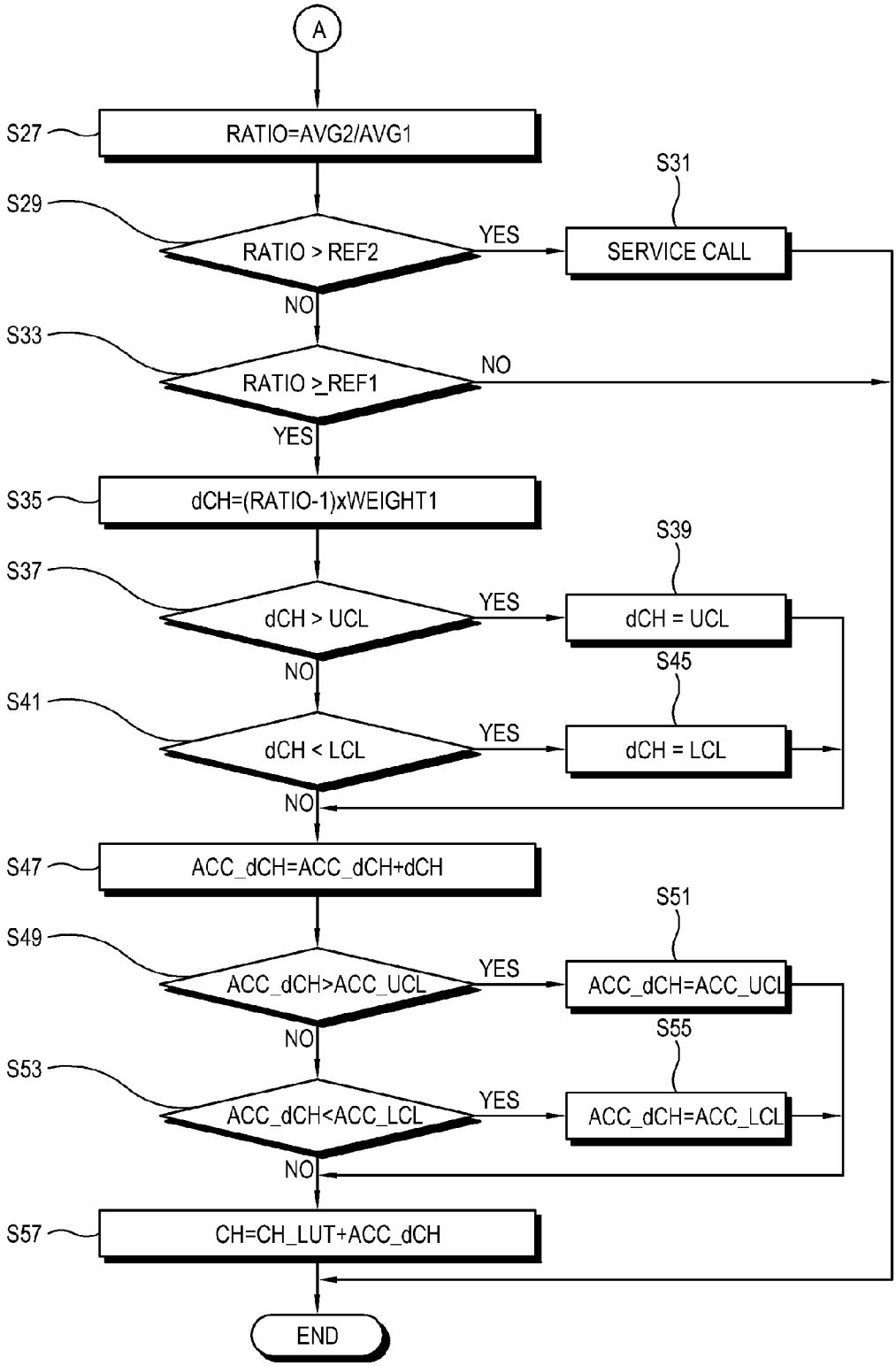

The control method according to the present exemplary embodiment will be described in more detail with reference to FIGS. 5A and 5B.

An initial developing condition is set in operation S11. For example, a lower control limit (LCL) and an upper control limit (UCL) of an allowable correction range may be set as 0 and 25, respectively, for a first control. Additionally, other controls may be set, for example, an accumulated lower control limit (ACC_LCL) and an accumulated upper control limit (ACC_UCL) of an accumulated allowable correction range may be set 0 and 50, respectively. The values 0, and 50 may be digital values AD-converted from control signals applied to the charging power source 23 (in FIG. 1). Further, additional controls may be set, including a first reference value (REF1) for background image generation may be set to a value of 1.03, for a comparison to be later described, a second reference value (REF2) for abnormal measurement may be set to a value of 1.5, for a comparison to be later described, a weight (WEIGHT1) for correction value calculation may be set to a value of 300 as a multiplier for a comparison to be later described, and an initial ratio value (RATIO) may be set as 0. Additionally, an accumulated correction value (ACC_dCH) may be initially set as 0, and a charging voltage control value (CH) may be initially set as 0. The values described above are for exemplary purposes only and are not limited thereto.

A first test condition, that is, a background free condition is set in operation S13. That is, a voltage difference between the charging voltage $V_C$ and the developing bias voltage $V_{DB}$ is set to be larger than that in the normal developing condition. For example, the charging voltage $V_C$ and the developing bias voltage $V_{DB}$ may be −800V and −100V, respectively.

The density is sensed in the first test condition and AD-converted into a digital value for output in operation S15. For example, the density may be sensed every 2 msec for one revolution of the photosensitive medium 10.

An average value (AVG1) of the AD-converted digital values for one revolution of the photosensitive medium 10 is calculated in operation S17. The average value (AVG1) may be calculated according to the sensed density of any number of revolutions of the photosensitive medium 10.

A second test condition in which a background image is relatively easy to generate compared with the normal developing condition is set in operation S19. That, a voltage difference between the charging voltage $V_C$ and the developing bias voltage $V_{DB}$ is set to be smaller than that in the normal developing condition. For example, the charging voltage $V_C$ and the developing bias voltage $V_{DB}$ may be −670V and −450V, respectively.

The density is sensed in the second test condition and AD-converted into a digital value for output in operation S21. For example, the density may be sensed every 2 msec for one revolution of the photosensitive medium 10.

An average value (AVG2) of the AD-converted digital values for one revolution of the photosensitive medium 10 is calculated in operation S23. The average value (AVG2) may be calculated according to the sensed density of any number of revolutions of the photosensitive medium 10.

In operations S15 and S21, the average values (AVG1 and AVG2) are calculated based on densities sensed for one revolution of the photosensitive medium 10, but may, for example, be calculated based on densities sensed for two or more revolutions of the photosensitive medium 10.

The charging voltage $V_C$ and the developing bias voltage $V_{DB}$ are changed to the normal developing condition so that the image forming apparatus under test can perform a normal printing operation in operation S25. For example, the charging voltage $V_C$ and the developing bias voltage $V_{DB}$ may be set −700V and −450V, respectively. This operation S25 is not necessarily needed in the present embodiment, and thus, may be omitted.

A ratio value (RATIO=AVG2/AVG1) between the average values (AVG1 and AVG2) in the first and second test conditions is calculated in operation S27. The calculated ratio value (RATIO=AVG2/AVG1) replaces the initial ratio value (RATIO).

It is determined whether the calculated ratio value (RATIO) is larger than the second reference value (REF2=1.5) in operation S29. If the calculated ratio value (RATIO) is larger than the second reference value (REF2), it is determined that the second test condition is beyond the allowable correction range. The controller 60 informs a user that the image forming apparatus needs to be repaired, for example, through a service call in operation S31, and the process terminates.

If the ratio value (RATIO) is not larger than the second reference value (REF2), it is determined whether the ratio value (RATIO) is larger than the first reference value (REF1=1.03) in operation S33. If the ratio value (RATIO) is not larger than or equal to the first reference value (REF1), it is determined that a background image is not generated in the second test condition. In other words, if the ratio value (RATIO) is less than the first reference value (REF1), the developing condition does not need to be adjusted, and the process terminates.

If the ratio value (RATIO) is larger than the first reference (REF1), a correction value (dCH) is calculated (operation S35). The correction value (dCH) may be calculated by the following equation:

$$dCH=(\text{RATIO}-1)*\text{WEIGHT1}$$

The weight (WEIGHT1) is a multiplier used to determine the correction value (dCH). The weight (WEIGHT1) may be determined so that when the multiplier is used as in the above equation, a correction value (dCH) can be accurately determined according to the weight (WEIGHT1) and the ratio value (RATIO).

The correction value (dCH) is compared with the upper control limit (UCL) in operation S37. If the correction value (dCH) is larger than the upper control limit (UCL), the correction value (dCH) is replaced with the upper control limit (UCL) in operation S39, and the process proceeds to operation S47 to be described later.

If the correction value (dCH) is not larger than the upper control limit (UCL), the correction value (dCH) is compared with the lower control limit (LCL) in operation S41. If the correction value (dCH) is smaller than the lower control limit (LCL), the correction value (dCH) is replaced with the lower control limit (LCL) in operation S45, and the process proceeds to operation S47.

If the correction value (dCH) is not smaller than the lower control limit (LCL), an accumulated correction value (ACC_dCH) is replaced with the sum of the accumulated correction value (ACC_dCH) and the new correction value (dCH) in operation S47.

The new accumulated correction value (ACC_dCH) is compared with the accumulated upper control limit (ACC_UCL) in operation S49. If the accumulated correction value (ACC_dCH) is larger than the accumulated upper control limit (ACC_UCL), the accumulated correction value (ACC_dCH) is replaced with the accumulated upper control limit (ACC_UCL) in operation S51, and the process proceeds to operation S57 to be described later.

If the accumulated correction value (ACC_dCH) is not larger than the accumulated upper control limit (ACC_UCL), the accumulated correction value (ACC_dCH) is compared with the accumulated lower control limit (ACC_LCL) in operation S53. If the accumulated correction value (ACC_dCH) is smaller than the accumulated lower control limit (ACC_LCL), the accumulated correction value (ACC_dCH) is replaced with the accumulated lower control limit (ACC_LCL) in operation S55, and the process proceeds to operation S57.

If the accumulated correction value (ACC_dCH) is not smaller than the accumulated lower control limit (ACC_LCL), a charging voltage control value (CH) is replaced with the sum of a charging voltage control value from a lookup table (CH_LUT) corresponding to a life of the photosensitive medium 10 and the accumulated correction value (ACC_dCH) in operation S57.

The charging voltage $V_C$ may be corrected based on the new charging voltage control value (CH), thereby preventing generation of a background image in image forming on a printing medium.

As described above, according to an image forming apparatus and a control method of the image forming apparatus according to the present general inventive concept, a charging voltage may be adjusted based on sensed densities of a non-image area of a photosensitive medium in predetermined first and second test conditions, thereby preventing background image generation on a printing medium.

The present general inventive concept can also be embodied as computer-readable codes on a computer-readable medium. The computer-readable medium can include a computer-readable recording medium and a computer-readable transmission medium. The computer-readable recording medium is any data storage device that can store data as a program which can be thereafter read by a computer system. Examples of the computer-readable recording medium include read-only memory (ROM), random-access memory (RAM), CD-ROMs, DVDs, Blu-Ray discs, magnetic tapes, floppy disks, optical data storage devices, and the like. The computer-readable recording medium can also be distributed over network coupled computer systems so that the computer-readable code is stored and executed in a distributed fashion. The computer-readable transmission medium can be transmitted through carrier waves or signals (e.g., wired or wireless data transmission through the Internet). Also, functional programs, codes, and code segments to accomplish the present general inventive concept can be easily construed by programmers skilled in the art to which the present general inventive concept pertains.

Although a few exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming apparatus, comprising:

a photosensitive medium;

a charger to charge the photosensitive medium;

an exposing unit to expose light to the photosensitive medium to form a latent image on the photosensitive medium;

a developing unit which is disposed opposite to the photosensitive medium to develop the latent image into a visible image;

a density sensing unit to sense a density of an area of the photosensitive medium; and a controller to determine whether a preset developing condition corresponds to a background image generating condition based on the density sensed by the density sensing unit and to adjust the developing condition based on the determination, the controller controlling the density sensing unit to sense a density of a non-image area on the photosensitive medium in a first test condition in which a background image is less likely to be generated compared with the preset developing condition and to sense a density of the non-image area on the photosensitive medium in a second test condition in which the background image is more likely to be generated compared with the preset developing condition.

2. The apparatus according to claim 1, wherein the controller controls the photosensitive medium and the density sensing unit so that a portion of the photosensitive medium sensed in the first test condition is substantially the same as a portion of the photosensitive medium sensed in the second test condition.

3. The apparatus according to claim 2, wherein the developing condition, the first test condition and the second test condition are respectively set by varying at least one of a charging voltage applied to the photosensitive medium by the charger and a developing bias voltage applied to the developing unit.

4. The apparatus according to claim 3, wherein the first test condition is set such that a voltage difference between the charging voltage and the developing bias voltage is larger than that in the preset developing condition.

5. The apparatus according to claim 3, wherein the second test condition is set such that a voltage difference between the charging voltage and the developing bias voltage is smaller than that in the preset developing condition.

6. The apparatus according to claim 1, wherein the density sensing unit comprises a light emitting part which emits light to the photosensitive medium and a light receiving part which receives light reflected from the photosensitive medium to measure an amount of light reflected from the photosensitive medium.

7. The apparatus according to claim 1, wherein the controller adjusts the developing condition at a predetermined cycle.

8. A control method in an image forming apparatus including a photosensitive medium and a developing unit, the method comprising:

charging the photosensitive medium at a predetermined voltage;

applying a developing bias voltage to the developing unit;

sensing a density on the non-image area in a first test condition in which a background image is less likely to be generated compared with the preset developing condition;

sensing a density on the non-image area in a second test condition in which a background image is more likely to be generated compared with the preset developing condition;

determining whether a preset developing condition corresponds to a background image generating condition according to the first and second densities; and adjusting the developing condition based on the determination.

9. The method according to claim 8, wherein the developing condition, the first test condition and the second test condition are respectively set by varying at least one of a charging voltage applied to the photosensitive medium and a developing bias voltage applied to the developing unit.

10. The method according to claim 9, wherein the first test condition is set such that a voltage difference between the charging voltage and the developing bias voltage is larger than that in the preset developing condition.

11. The method according to claim 9, wherein the second test condition is set such that a voltage difference between the charging voltage and the developing bias voltage is smaller than that in the preset developing condition.

12. The method according to claim 9, wherein the adjusting of the developing condition comprises:

determining whether a ratio between the sensed densities of the first and second test conditions is beyond a predetermined allowable correction range; and correcting the developing condition within the allowable correction range if the ratio is within the predetermined allowable correction.

13. The method according to claim 8, further comprising:

controlling the image forming apparatus such that a portion of the photosensitive medium sensed in the first test condition is substantially the same as a portion of the photosensitive medium sensed in the second test condition.

14. The method according to claim 8, wherein the adjusting of the developing condition is performed at a predetermined cycle.

15. A method of controlling an image forming apparatus including a photosensitive medium and a developing unit, the method comprising:

applying a preset developing condition including a charging voltage to be applied to the photosensitive medium and a developing bias voltage to develop an image on the photosensitive medium;

sensing a first density on a non-image area in a first test condition in which a background image is less likely to be generated compared with the preset developing condition; and sensing a second density on the non-image area in a second test condition in which a background image is more likely to be generated compared with the preset developing condition;

determining whether the preset developing condition corresponds to a background image generating condition according to the first and second densities; and adjusting the developing condition based on the determination.

16. An image forming apparatus, comprising:

a photosensitive medium;

a charger to charge the photosensitive medium;

an exposing unit to expose light to the photosensitive medium to form a latent image on the photosensitive medium;

a developing unit which is disposed opposite to the photosensitive medium to develop the latent image into a visible image;

a density sensing unit to sense a first density of a first portion of a non-image area of the photosensitive medium and to sense a second density of a second portion of the non-image area of the photosensitive medium; and a controller to determine whether a preset developing condition corresponds to a background image generating condition based on the first and second densities sensed by the density sensing unit, and to adjust the developing condition based on the determination.

* * * * *